US006595876B2

(12) United States Patent
Kasashima et al.

(10) Patent No.: US 6,595,876 B2
(45) Date of Patent: Jul. 22, 2003

(54) GOLF BALL

(75) Inventors: Atsuki Kasashima, Chichibu (JP); Keisuke Ihara, Chichibu (JP); Kazuto Maehara, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/776,690

(22) Filed: Feb. 6, 2001

(65) Prior Publication Data

US 2001/0018372 A1 Aug. 30, 2001

(30) Foreign Application Priority Data

Feb. 7, 2000 (JP) ..... 2000-029341

(51) Int. Cl.[7] ..... A63B 37/14
(52) U.S. Cl. ..... 473/382; 473/384; 473/383
(58) Field of Search ..... 473/382, 378, 473/380, 379, 383; 40/327

(56) References Cited

U.S. PATENT DOCUMENTS 4,915,389 A * 4/1990 Ihara ..... 473/379
4,960,281 A * 10/1990 Aoyama ..... 473/380
5,078,402 A * 1/1992 Oka ..... 40/327
5,145,180 A * 9/1992 Oka ..... 40/327
5,156,404 A * 10/1992 Oka et al. ..... 473/382
5,201,523 A * 4/1993 Miller ..... 473/378
5,415,410 A * 5/1995 Aoyama ..... 473/382
5,564,708 A * 10/1996 Hwang ..... 473/382
6,200,232 B1 * 3/2001 Kasashima et al. ..... 473/379
6,241,627 B1 * 6/2001 Kasashima et al. ..... 473/378
6,346,054 B1 * 2/2002 Shimosaka et al. ..... 473/378
6,358,161 B1 * 3/2002 Aoyama ..... 473/383

* cited by examiner

*Primary Examiner*—Paul T. Sewell
*Assistant Examiner*—Tom P Duong
(74) *Attorney, Agent, or Firm*—Sughrue Mion, PLLC

(57) ABSTRACT

Disclosed is a golf ball including: a plurality of dimples arranged overall on the spherical surface of the golf ball by assuming the spherical surface of the golf ball as a spherical octahedron and using, as dimple arrangement units, eight spherical triangles constituting the spherical octahedron, on each of which a specific number of the dimples are arranged. In this golf ball, at least the four dimples are arranged on each of three sides of the spherical triangle; there is no great circle with which none of the dimples intersects; and the total number of the dimples is in a range of 380 to 450.

7 Claims, 12 Drawing Sheets

GOLF BALL

BACKGROUND OF THE INVENTION

The present invention relates to a golf ball capable of exhibiting a stable flying performance by highly symmetrically, equally arranging dimples on the surface of the ball by a spherical octahedron arrangement method.

A large number of dimples are arranged on the outer surface of a golf ball for increasing the flying performance of the golf ball. The flying performance of a golf ball, however, varies depending on the rotational direction (the latitudinal direction, longitudinal direction, or the intermediate direction therebetween) of the golf ball, which differs depending on a hitting point of a ball. The variation in rotational direction of the golf ball depending on a hitting point of a ball is mainly due to the distribution of the dimples arranged on the surface of the ball. From this viewpoint, various methods have been proposed to reduce a variation in flying performance of a golf ball by enhancing the uniformity as much as possible in arrangement of dimples on the surface of the golf ball.

With respect to such dimple arrangement, from the practical viewpoint, there has been generally used a method of arranging dimples on the spherical surface of the golf ball by assuming the spherical surface of the golf ball as a spherical polyhedron such as an icosahedron or an octahedron and using, as dimple arrangement units, spherical triangles constituting the spherical octahedron, on each of which a specific number of the dimples are equally arranged.

FIG. 13 shows an example of spherical regular octahedron arrangement. Referring to FIG. 13, the spherical surface of the golf ball is equally divided into eight spherical triangles T forming a spherical octahedron by a longitudinal line "a" (0° to 180°), a longitudinal line "b" (90° to 270°), and an equatorial line. Dimples of the total number of 368 are arranged on the spherical surface of the golf ball by using as dimple arrangement units, the spherical triangles T on each of which 46 of four types of dimples different in diameter, concretely, large dimples $D_1$, medium dimples $D_2$, small dimples $D_3$, and minimum dimples $D_4$ are equally arranged. In the figure, character "e" designates a pole.

In this example, on each of three sides of the spherical triangle T, any dimple is not formed but a land is formed for simplifying the works of molding the golf ball. To be more specific, on each of three great circles composed of the longitudinal lines "a" and "b" and the equatorial line "c", any dimple is not formed but a land is continuously formed.

For such a golf ball, an aerodynamic effect of the dimples differs between the case where the golf ball rotates in the direction along either of the three great circles a "b" and "c" on which the land is continuously formed and the case where the golf ball rotates in the direction deviated from any one of the great circles, with a result that there arises a problem that the flying performance of the golf ball varies depending on a hitting point of the golf ball.

To solve such an inconvenience and to increase the uniformity of the arrangement of dimples, there has been proposed a spherical octahedron arrangement method in which one or a plurality of dimples are arranged on a side, extending in the longitudinal direction, of a spherical triangle. In this case, since each dimple located on the side, extending in the longitudinal direction, of the triangle must be in a left-right symmetric relationship with respect to the side of the triangle, the center of the dimple is located on the side of the triangle. That is to say, in this case, the dimple is equally divided into two parts by the side of the triangle.

On the other hand, generally, any dimple is not arranged on a side, corresponding to the equatorial line, of the spherical triangle. The reason for this is due to the fact that since the equatorial line is generally taken as a great circle corresponding to a mold parting plane, if any one of dimples is located on the equatorial line, it is difficult to perform a work of finishing the molded golf ball because of the structure of a mold for molding the golf ball.

Such a golf ball produced in accordance with the above-described proposed method, however, also has the problem that the flying performance of the golf ball varies depending on the rotational direction of the golf ball.

SUMMARY OF THE INVENTION

An object of the present invention is to provide a golf ball capable of highly symmetrically, equally arranging dimples on the surface of the ball by a spherical octahedron arrangement method, thereby exhibiting a stable flying performance irrespective of a hitting point of a ball.

To achieve the above object, according to the present invention, there is provided a golf ball including: a plurality of dimples arranged overall on the spherical surface of the golf ball by assuming the spherical surface of the golf ball as a spherical octahedron and using, as dimple arrangement units, eight spherical triangles constituting the spherical octahedron, on each of which a specific number of the dimples are arranged; wherein at least the four dimples are arranged on each of three sides of the spherical triangle; there is no great circle with which any one of the dimples does not intersect; and the total number of the dimples is in a range of 380 to 450.

In this golf ball, the dimples may be arranged on the surface of the ball in such a manner that one of four great circles formed by connecting associated ones of mid points of sides of the spherical triangles to each other is an equatorial line which substantially corresponds to a parting plane of a two-half mold for molding the golf ball, and the great circle corresponding to the equatorial line has no dimple whose center intersects with the great circle.

With this configuration, it is possible to significantly improve the aerodynamic characteristic of the golf ball as compared with a conventional golf ball, and to equalize the flying performance of the golf ball by significantly reducing a variation in flying performance of the golf ball due to a difference in hitting point between shots.

Further, according to the present invention, since the area of a portion, extending in the direction deviated from the equatorial line, of a parting plane of a two-half mold for molding the golf ball is small, the polishing width becomes narrow, with a result that the polishing amount becomes small, and since no burr occurs in each dimple, the polishing work becomes easy and also an undesirable deformation of each dimple located on the equatorial line can be prevented. As a result, the golf ball molded using such a mold is significantly advantageous in keeping the uniformity of the dimple effect (aerodynamic characteristic) of the golf ball.

DETAILED DESCRIPTION OF THE PREFERRED EMBODIMENTS

Preferred embodiments of the present invention will be described with reference to the accompanying drawings.

[First Embodiment]

Figure 1:
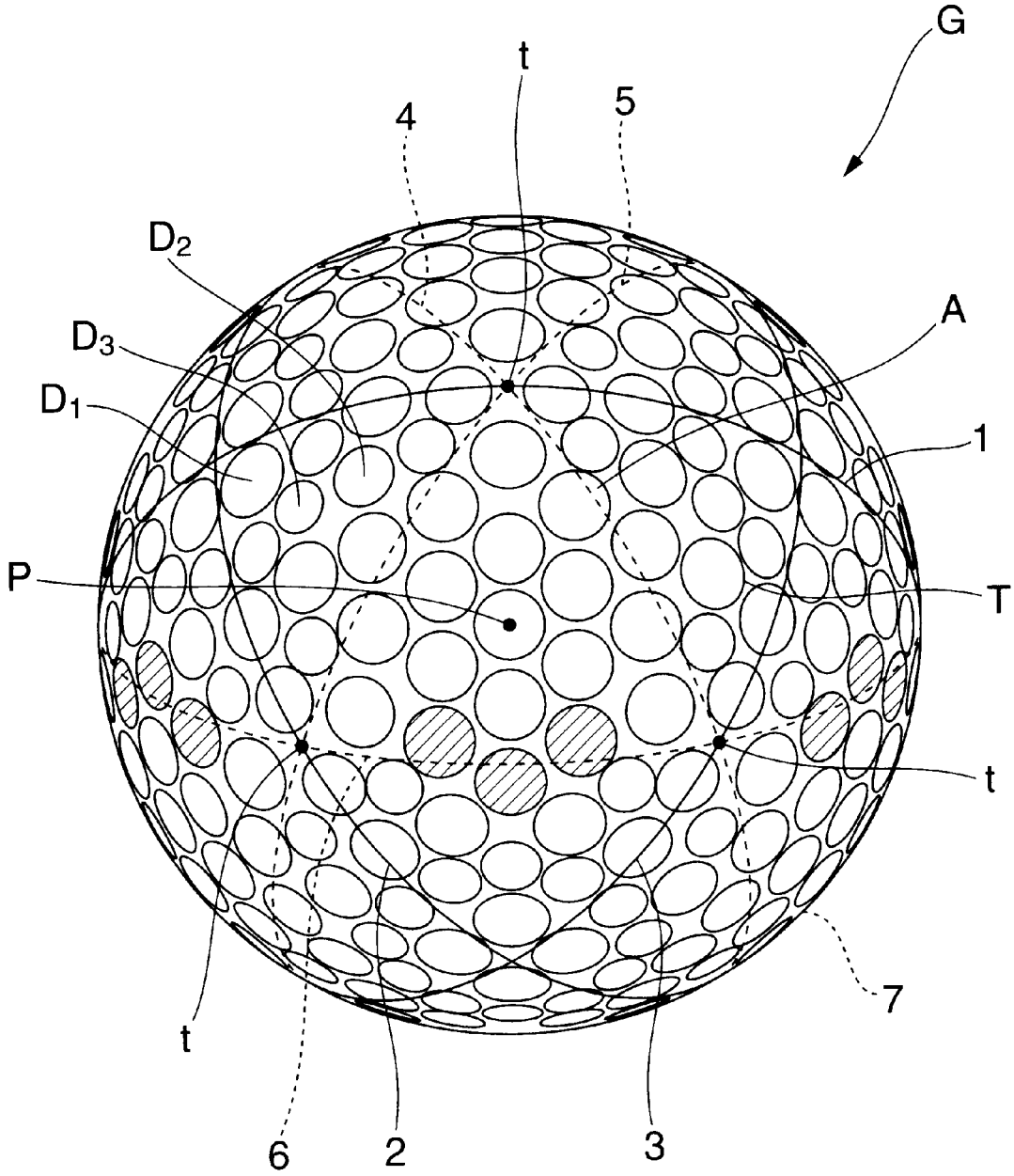
FIG. 1 is a plan view, as seen from the pole direction, showing a golf ball according to a first embodiment.
Figure 2:
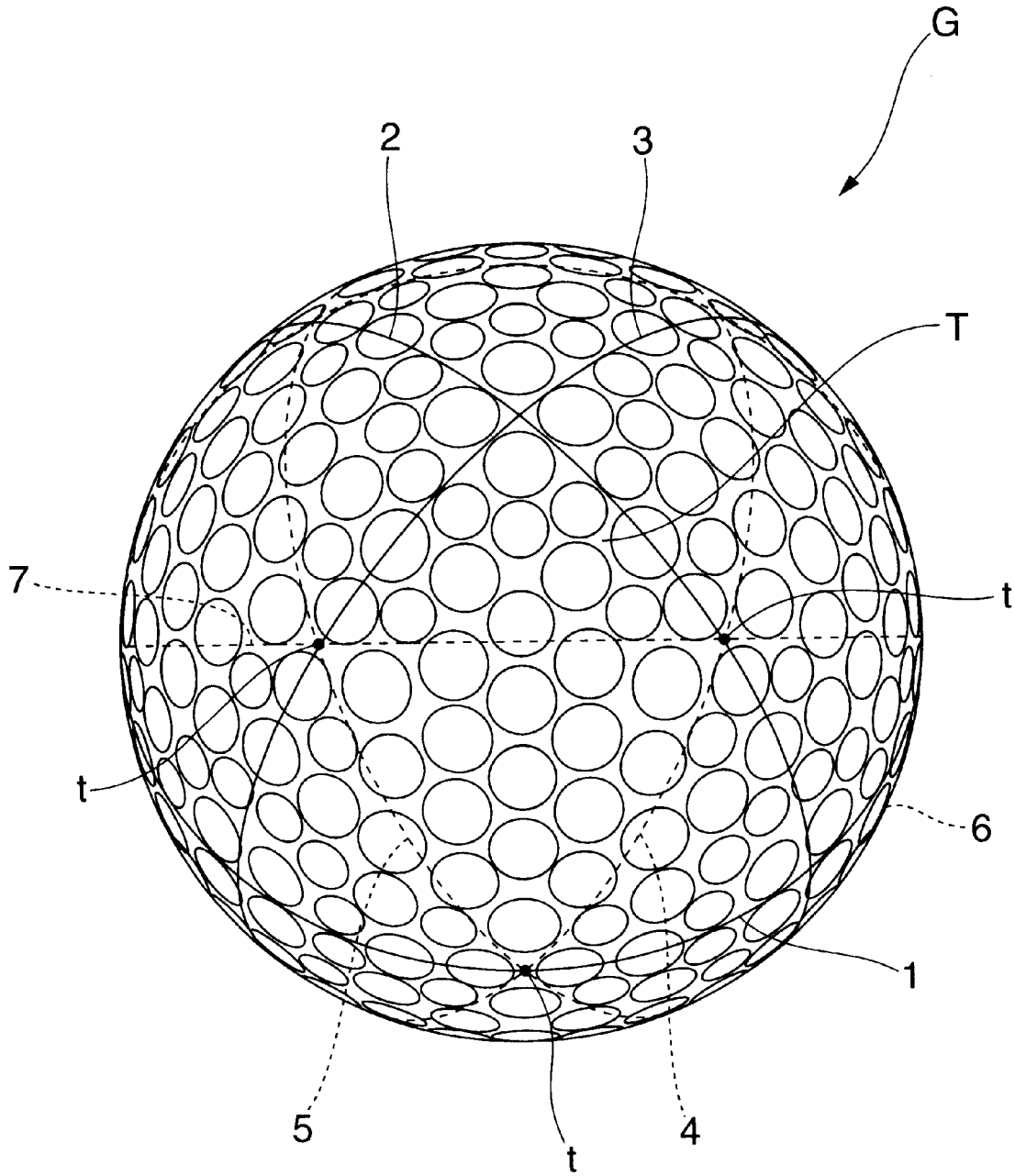
FIG. 2 is a side view of the golf ball shown in FIG.

FIG. 1 is a plan view, as seen from the pole direction, showing a golf ball according to a first embodiment of the present invention, and FIG. 2 is a side view of the golf ball shown in FIG. 1. Referring to FIGS. 1 and 2, the spherical surface of a golf ball G is assumed as a spherical octahedron, and is equally divided into eight spherical triangles T constituting the spherical octahedron by three great circles shown by solid lines 1, 2 and 3, wherein the center of gravity of one of these triangles T corresponds to a north pole P of the ball G, and the center of gravity of the opposed one of these triangles T corresponds to a south pole (not shown) of the ball G.

According to the first embodiment, 43 dimples are equally arranged inside each spherical triangle T, and four dimples are arranged on each of the three sides of the spherical triangle T in such a manner as to be centered on the side of the spherical triangle T, that is, to be in a left-right symmetric relationship with respect to the side of the spherical triangle T. Accordingly, the 49 dimples of [43+(4+4+4)/2]=49] are arranged in the spherical triangle T, and therefore, the total 392 dimples of [49×8=392] are uniformly arranged on the spherical surface of the golf ball G. According to the present invention, the number of the dimples arranged on each of the three sides of the spherical triangle T may be at least 4, preferably, in a range of 4 to 10.

In accordance with the first embodiment, as shown in FIG. 1, three types of dimples different in diameter and/or depth, more specifically, large dimples $D_1$ (diameter: 4.0 mm, depth: 0.19 mm), medium dimples $D_2$ (diameter: 3.8 mm, depth: 0.18 mm), and small dimples $D_3$ (diameter: 3.15 mm, depth: 0.16 mm) are equally arranged on the spherical surface of the golf ball G. The total number of the dimples $D_1$, $D_2$ and $D_3$ is set to 392. According to the present invention, the total number of the dimples may be in a range of 380 to 450, and the types of dimples different in diameter and/or depth may be two or more, preferably in a range of two to five.

According to the first embodiment, on the spherical surface of the golf ball, there is no great circle with which any one of the dimples does not intersect. To be more specific, since the four dimples intersect with each of the three sides of the spherical triangle T in such a manner as to be centered on the side of the spherical triangle T as described above, the 16 dimples intersect with each of the three great circles 1, 2, and 3 formed by the extensions (solid lines) of the three sides of the spherical triangle T in such a manner as to be centered on the great circle. According to the present invention, the number of the dimples intersecting with each of the great circles 1, 2 and 3 formed by the extensions of the three sides of one of the spherical triangles may be preferably in a range of 16 to 40.

According to the first embodiment, as shown in FIGS. 1 and 2, any dimple is not located at a midpoint "t" between two vertexes of each spherical triangle T, and four great circles shown by chain lines 4, 5, 6, and 7 pass through the associated ones of the mid points "t" on the sides of the spherical triangles T. In addition, the great circle 7 (see FIG. 2) becomes the equatorial line, which corresponds to a parting plane of a mold of a type being divided into upper and lower molds. The 18 dimples are located on each of the great circles 4 to 7 in such a manner as to partially intersect with the great circle, that is, not to be centered on the great circle or not to be in a left-right symmetric relationship with respect to the great circle. In addition, the dimples partially intersecting with the great circle 6 are shown by hatching in FIG. 1. According to the present invention, the number of the dimples partially intersecting with each of the great circles passing through the associated ones of the midpoints of the sides of the spherical triangles may be in a range of 6 to 42, preferably, 12 to 30.

In this way, on the spherical surface of the golf ball according to the first embodiment, there is no great circle with which any one of dimples does not intersect.

According to the present invention, to allow some of the dimples to partially intersect with each of the great circles passing through associated ones of the mid points of the sides of the triangles, it is required not to provide any dimple at the mid points "t" on the sides of the spherical triangle T. In this first embodiment, as shown in FIGS. 1 and 2, the arrangement of the dimples, each having the center corresponding to the center of each of the great circles passing through associated ones of the mid points "t" of the sides of the triangles T, is avoided.

Figure 3:
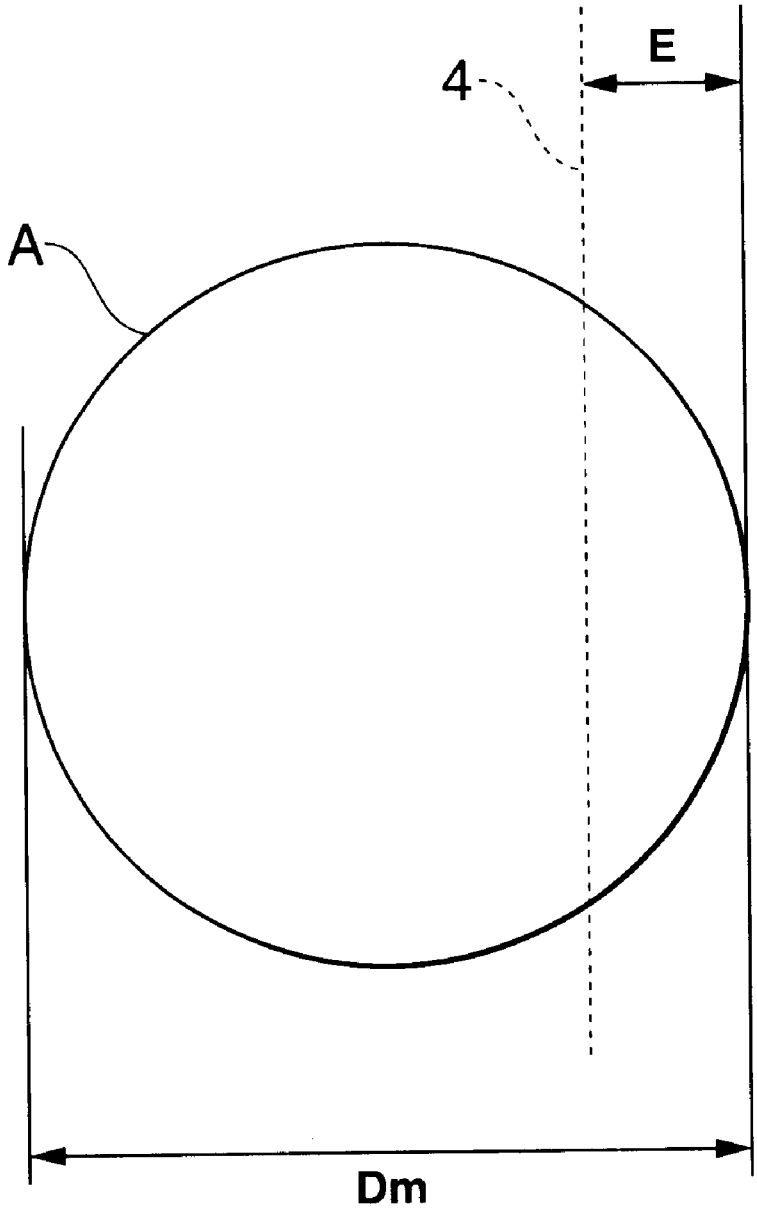
FIG. 3 is a schematic view illustrating an intersection width between a dimple and a great circle shown in FIG. 1.

More specifically, as shown in FIG. 3, a ratio [(E/Dm)× 100] of an intersection width E between a dimple A and a great circle 4 passing through mid points of sides of triangles to a diameter Dm of the dimple A may be in a range of 40% or less, preferably, in a range of 10 to 30%.

The arrangement of the dimples intersecting with each of the great circles passing through the associated ones of the mid points of the sides of the spherical triangles T in such a manner as not to be centered on the great circle as described above is advantageous in that if one of the great circles corresponds to the equatorial line taken as the parting plane of a mold, it is easy to finish the mold by machining and to remove burrs of a molded ball by polishing.

In general, a golf ball is molded by using a mold having an internal spherical cavity, on the inner wall surface of which a large number of projections for forming dimples are formed, wherein the mold is of a type being divided into upper and lower molds having a parting plane at a position on the equatorial line of the cavity.

In this case, to form some of the dimples on the equatorial line, the dimple forming projections must be equally divided along the parting plane of the mold into two parts which are needed to be provided on the upper and lower molds, respectively. If a golf ball is made from a usual thermoplastic resin by injection-molding using such a mold, burrs necessarily occur at the position, corresponding to the parting plane of the mold, of the golf ball, and after molding, these burrs must be removed by polishing. The work of removing the burrs occurring in the dimples, however, is substantially difficult.

Figure 4:
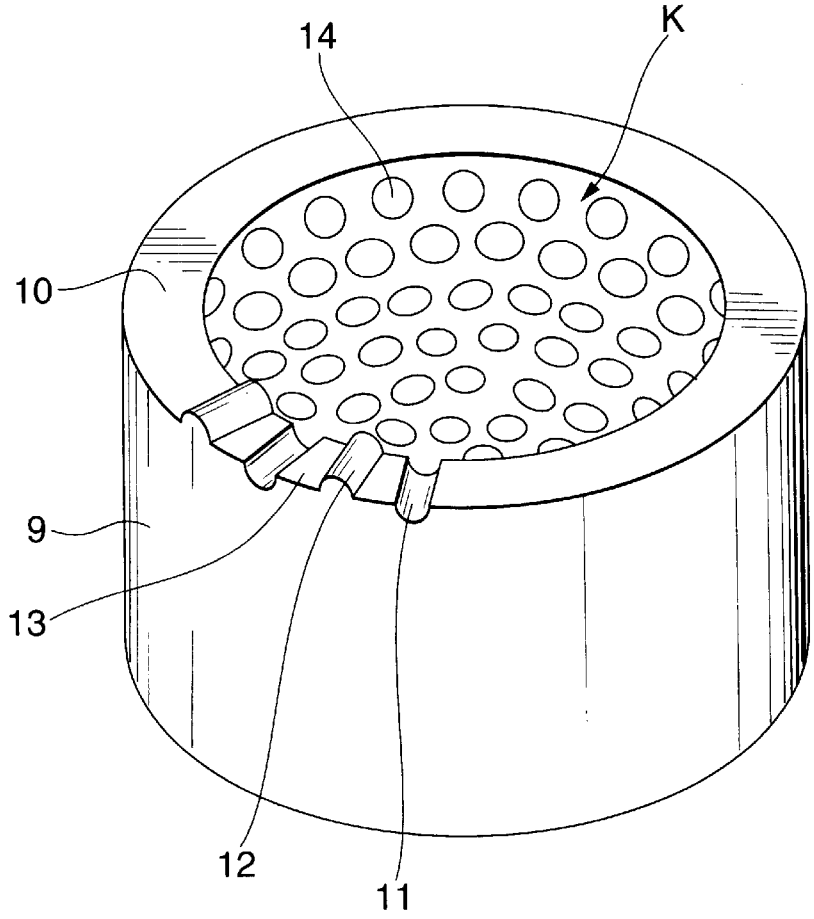
FIG. 4 is a perspective view of a lower half of a mold for molding the golf ball of the present invention.
Figure 5:
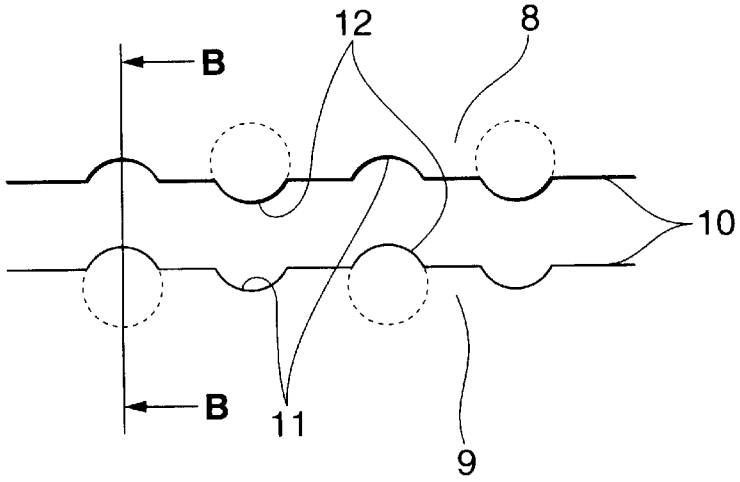
FIG. 5 is an enlarged view showing a parting plane of the mold shown in FIG. 4.
Figure 6:
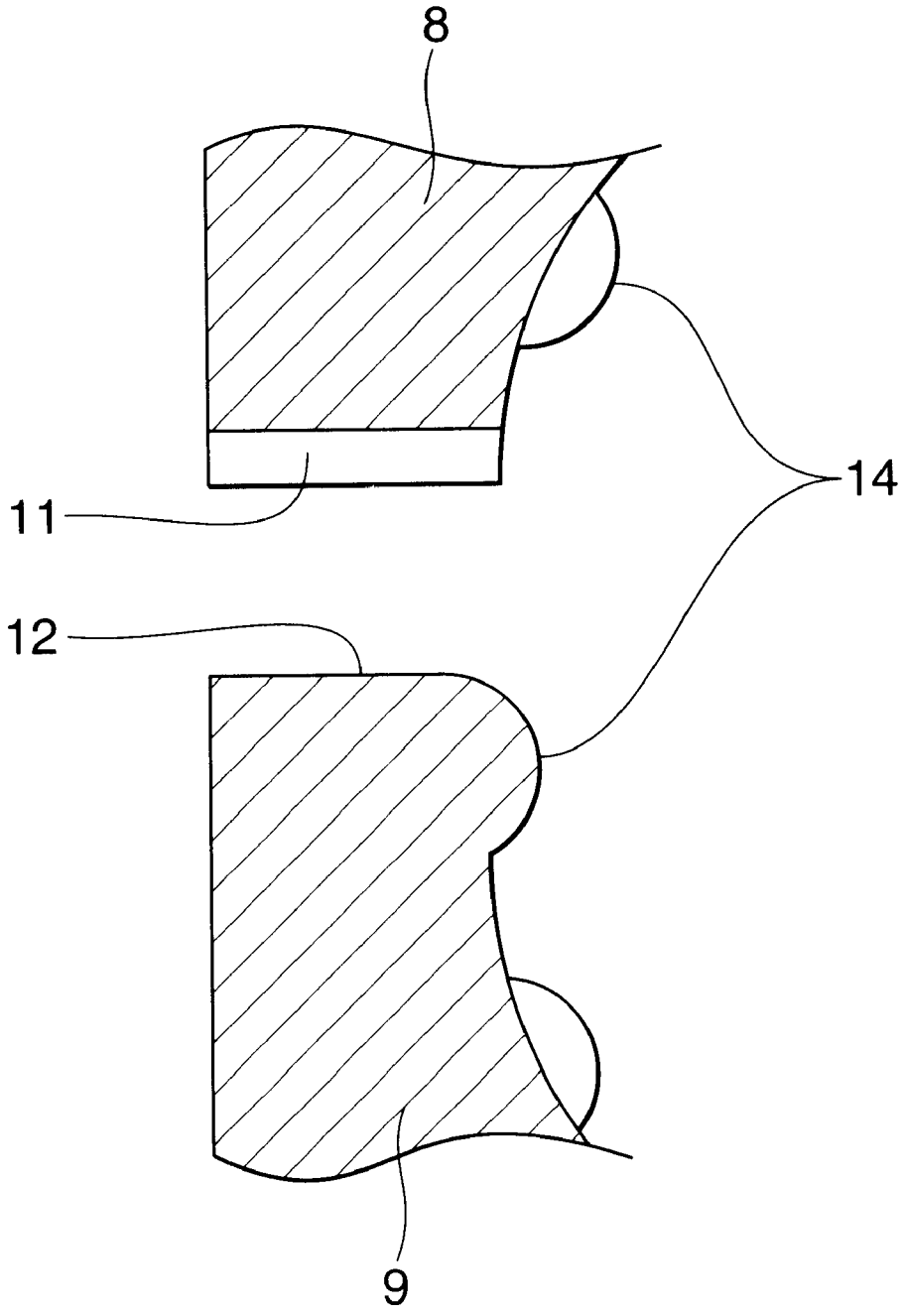
FIG. 6 is a partial sectional view taken on line B—B of FIG. 5.

On the contrary, according to the present invention, as shown in FIGS. 4 to 6, a parting plane 10 of a mold for molding a golf ball, which is divided into an upper mold 8 and a lower mold 9, is formed by a portion (a land forming portion 13) extending on the equatorial line and a portion (projections 12 and grooves 11) extending along the edges of projections 14 for forming dimples, that is, in the direction deviated from the equatorial line. When a golf ball is molded by using such a mold, burrs are formed along the parting plane 10; however, as shown in FIG. 3, since the intersection width E between the dimple A and the great circle 4 (that is, the projecting amount of each projection 12 and the recessed amount of each groove 11) is small, that is, the area of the portion extending in the direction deviated from the equatorial line is small, the polishing width becomes narrow, with a result that the polishing amount becomes small, and since no burr occurs in each dimple, the polishing work becomes easy and also an undesirable deformation of each dimple located on the equatorial line can be prevented. As a result, the golf ball molded using such a mold is significantly advantageous in keeping the uniformity of the dimple effect (aerodynamic characteristic) of the golf ball.

[Second Embodiment]

Figure 7:
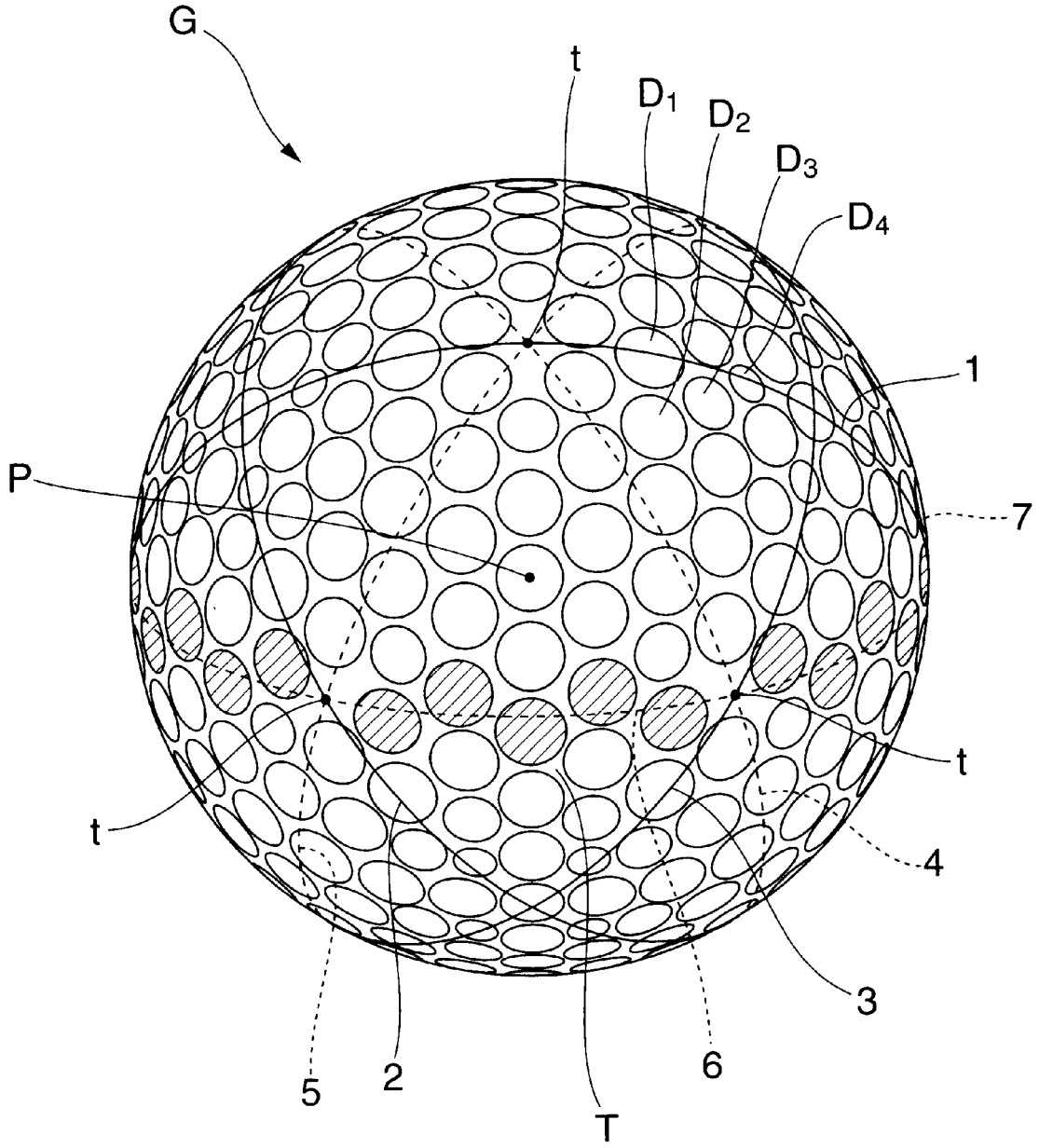
FIG. 7 is a plan view, as seen from the pole direction, showing a golf ball according to a second embodiment.
Figure 8:
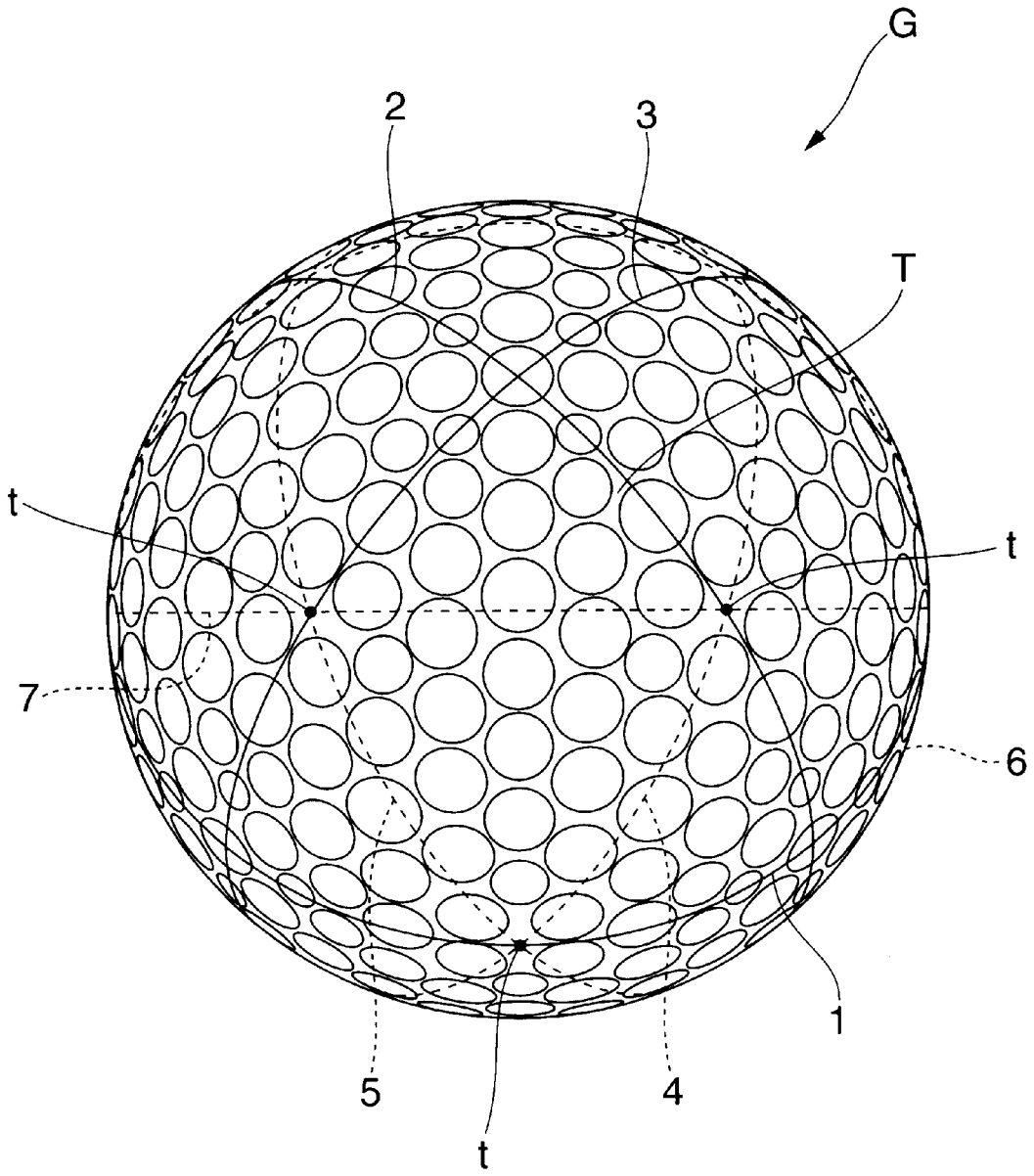
FIG. 8 is a side view of the golf ball shown in FIG. 7.

FIG. 7 is a plan view, as seen from the pole direction, showing a golf ball according to a second embodiment of the present invention, and FIG. 8 is a side view of the golf ball shown in FIG. 7.

According to the second embodiment, four types of dimples different in diameter and/or depth, more specifically, large dimples $D_1$ (diameter: 4.0 mm, depth: 0.19 mm), medium dimples $D_2$ (diameter: 3.8 mm, depth: 0.18 mm), small dimples $D_3$ (diameter: 3.15 mm, depth: 0.16 mm), minimum dimples $D_4$ (diameter: 2.35 mm, depth: 0.13 mm) are equally arranged on the spherical surface of the golf ball. The total number of the four types of dimples is set to 398.

Even in the second embodiment, on the spherical surface of the golf ball, there is no great circle with which any one of the dimples does not intersect. To be more specific, since five ($4+1/2\times2=5$) of the dimples intersect with each of the three sides of a spherical triangle T in such a manner that the centers of the dimples are on the side of the spherical triangle T, the 20 dimples intersect with each of three great circles 1, 2, and 3 formed by the extensions (solid lines) of the three sides of the spherical triangle T in such a manner that the centers of the dimples are on the great circles. Further, the 30 dimples are arranged on each of great circles 4 to 7 passing through the associated ones of midpoints "t" of the sides of the spherical triangles T in such a manner as to partially intersect with the great circle, that is, in such a manner that the centers of the dimples are not on the great circle. The dimples partially intersecting with the great circle 6 are shown by hatching in FIG. 7.

The configuration of the second embodiment is the same as that of the first embodiment except for the above feature, and therefore, parts corresponding to those described in the first embodiment are designated by the same characters and the overlapped description thereof is omitted.

[Third Embodiment]

Figure 9:
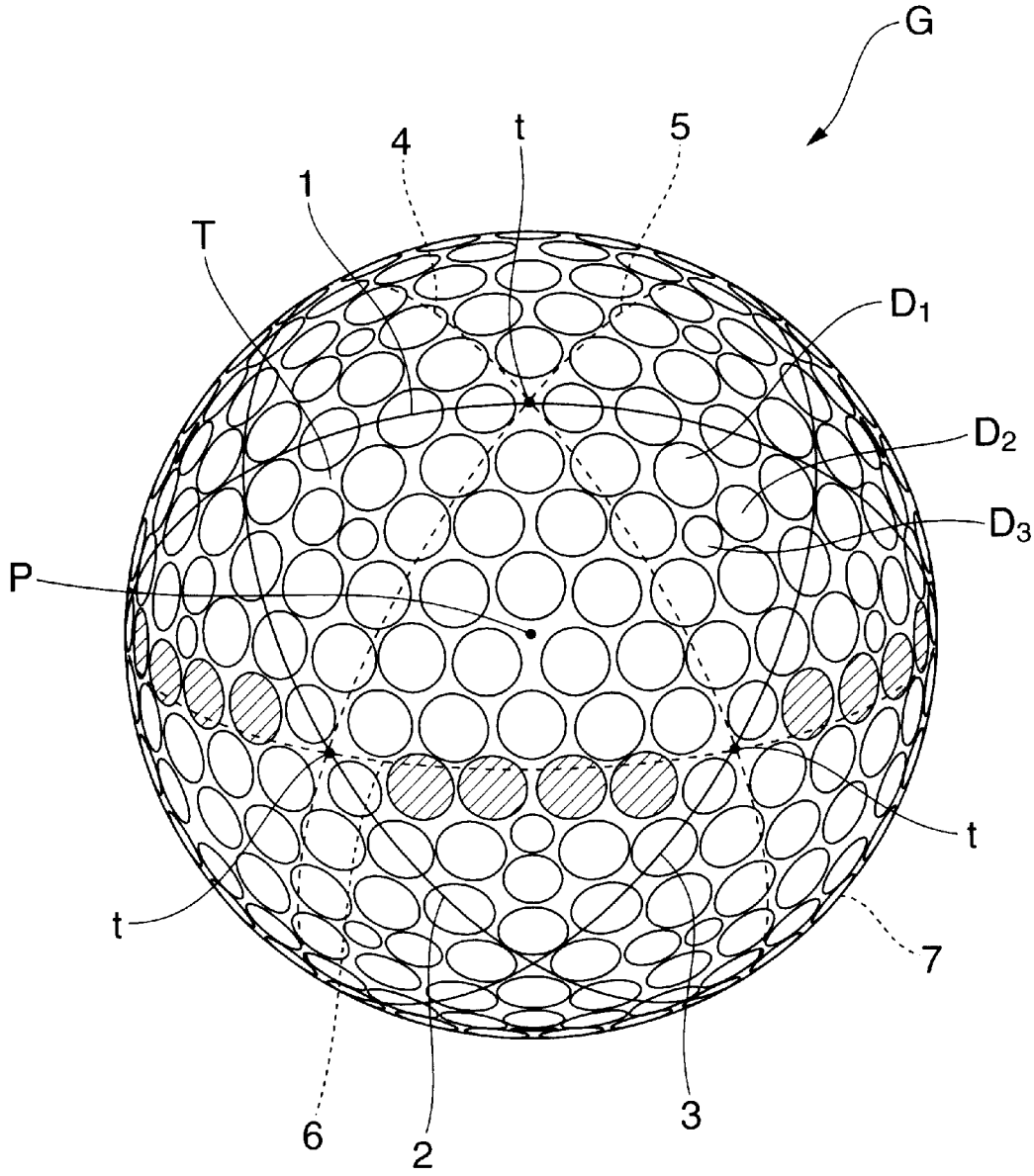
FIG. 9 is a plan view, as seen from the pole direction, showing a golf ball according to a third embodiment.
Figure 10:
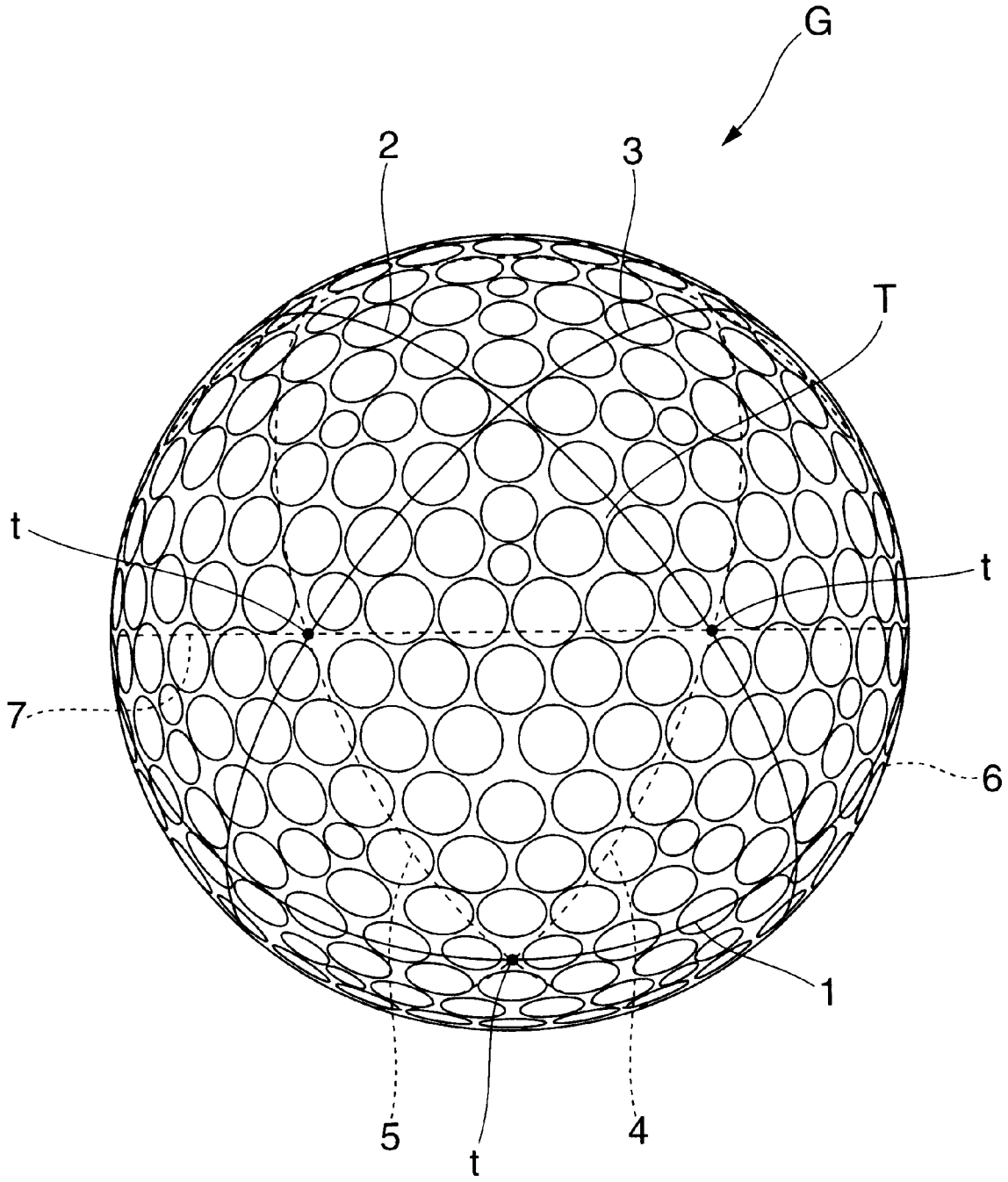
FIG. 10 is a side view of the golf ball shown in FIG. 9.

FIG. 9 is a plan view, as seen from the pole direction, showing a golf ball according to a third embodiment of the present invention, and FIG. 10 is a side view of the golf ball shown in FIG. 9.

According to the third embodiment, three types of dimples different in diameter and/or depth, more specifically, large dimples $D_1$ (diameter: 3.8 mm, depth: 0.18 mm), medium dimples $D_2$ (diameter: 3.2 mm, depth: 0.15 mm), and small dimples $D_3$ (diameter: 2.35 mm, depth: 0.13 mm) are uniformly arranged on the spherical surface of the golf ball. The total number of the dimples is set to 408.

Even in the third embodiment, on the spherical surface of the golf ball, there is no great circle with which any one of the dimples does not intersect. To be more specific, since the six dimples intersect with each of the three sides of a spherical triangle T in such a manner as to be centered on the side of the spherical triangle T, the 24 dimples intersect with each of three great circles 1, 2, and 3 formed by the extensions (solid lines) of the three sides of the spherical triangle T in such a manner that the centers of the dimples are on the great circle. Further, the 24 dimples are arranged on each of great circles 4 to 7 passing through the associated ones of midpoints "t" of the sides of the spherical triangles T in such a manner as to partially intersect with the great circle, that is, in such a manner that the centers of the dimples are not on the great circle. The dimples partially intersecting with the great circle 6 are shown by hatching in FIG. 9.

The configuration of the third embodiment is the same as that of the first embodiment except for the above feature, and therefore, parts corresponding to those described in the first embodiment are designated by the same characters and the overlapped description thereof is omitted.

[Fourth Embodiment]

Figure 11:
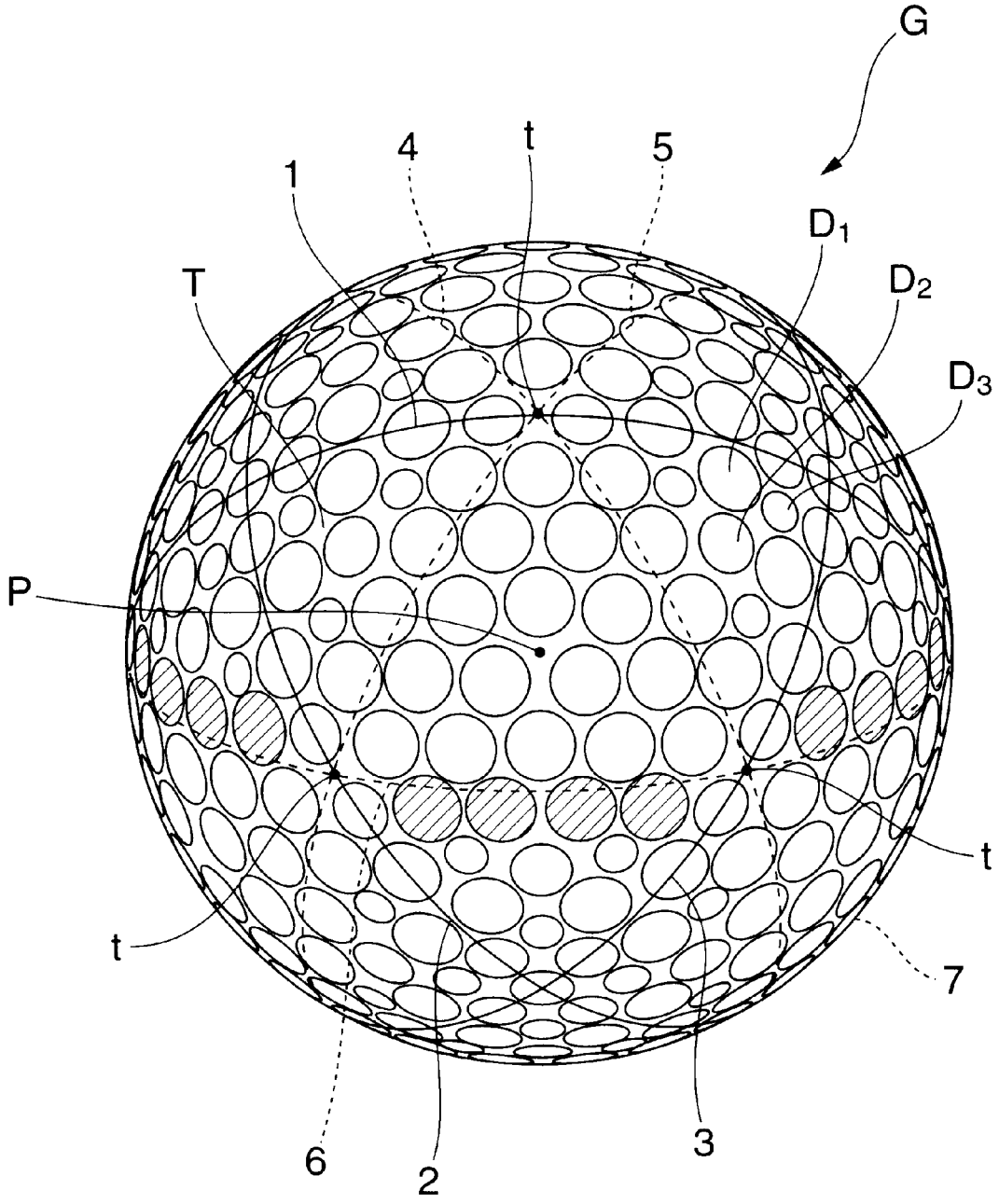
FIG. 11 is a plan view, as seen from the pole direction, showing a golf ball according to a fourth embodiment.
Figure 12:
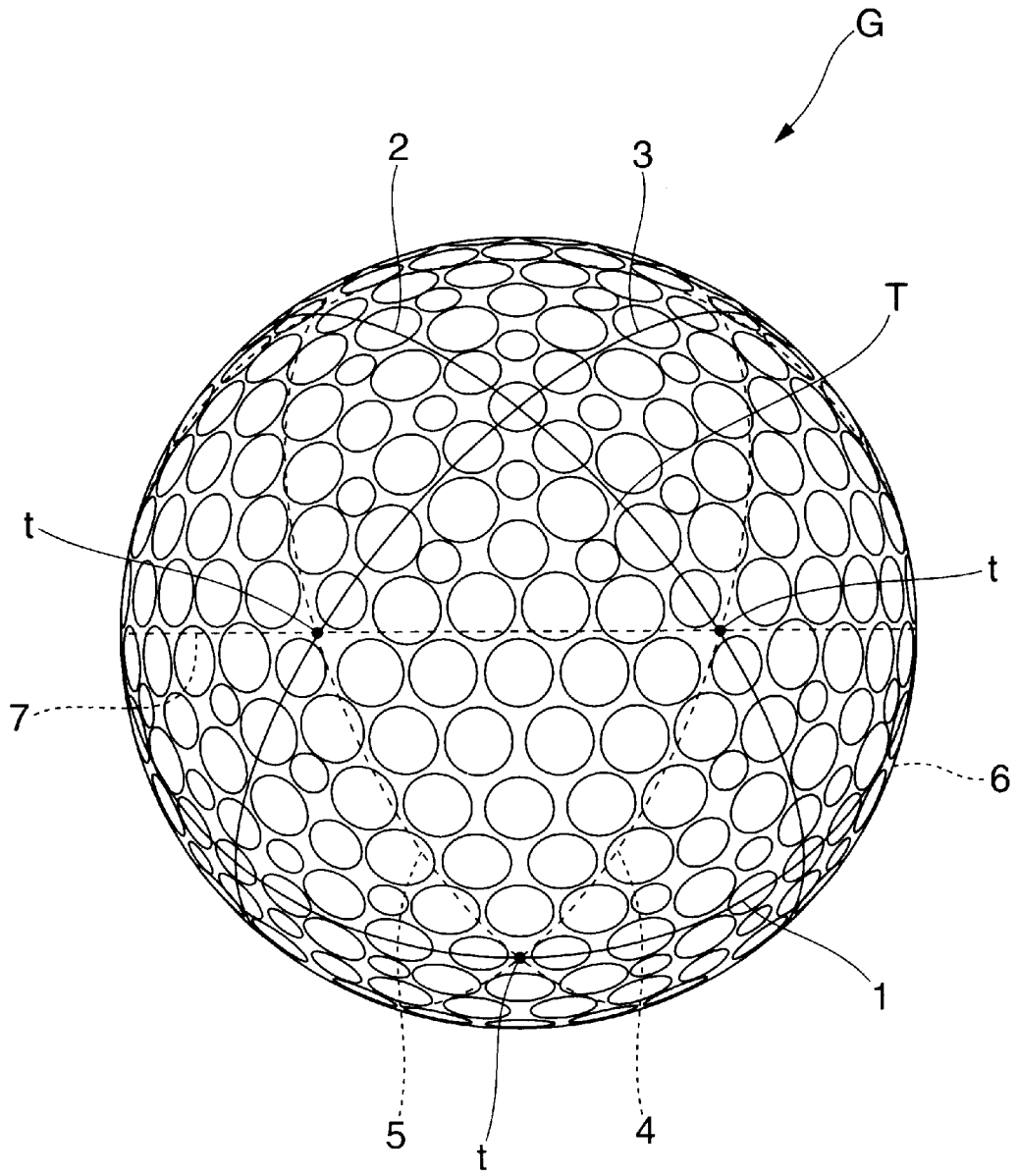
FIG. 12 is a side view of the golf ball shown in FIG. 11.

FIG. 11 is a plan view, as seen from the pole direction, showing a golf ball according to a fourth embodiment of the present invention, and FIG. 12 is a side view of the golf ball shown in FIG. 11.

According to the fourth embodiment, three types of dimples different in diameter and/or depth, more specifically, large dimples $D_1$ (diameter: 3.8 mm, depth: 0.18 mm), medium dimples $D_2$ (diameter: 3.2 mm, depth: 0.15 mm), and small dimples $D_3$ (diameter: 2.35 mm, depth: 0.13 mm) are equally arranged on the spherical surface of the golf ball. The total number of the dimples is set to 438.

Even in the fourth embodiment, on the spherical surface of the golf ball, there is no great circle with which any one of the dimples does not intersect. To be more specific, since seven ($6+1/2\times2$) of the dimples intersect with each of the three sides of a spherical triangle T in such a manner as to be centered on the side of the spherical triangle T, the 28 dimples intersect with each of three great circles 1, 2, and 3 formed by the extensions (solid lines) of the three sides of the spherical triangle T in such a manner as to be centered on the great circle. Further, the 24 dimples are arranged on each of great circles 4 to 7 passing through the associated ones of midpoints "t" of the sides of the spherical triangles T in such a manner as to partially intersect with the great circle, that is, in such a manner that the centers of the dimples are not on the great circle. The dimples partially intersecting with the great circle 6 are shown by hatching in FIG. 11.

The configuration of the fourth embodiment is the same as that of the first embodiment except for the above feature, and therefore, parts corresponding to those described in the first embodiment are designated by the same characters and the overlapped description thereof is omitted.

COMPARATIVE EXAMPLE

Figure 13:
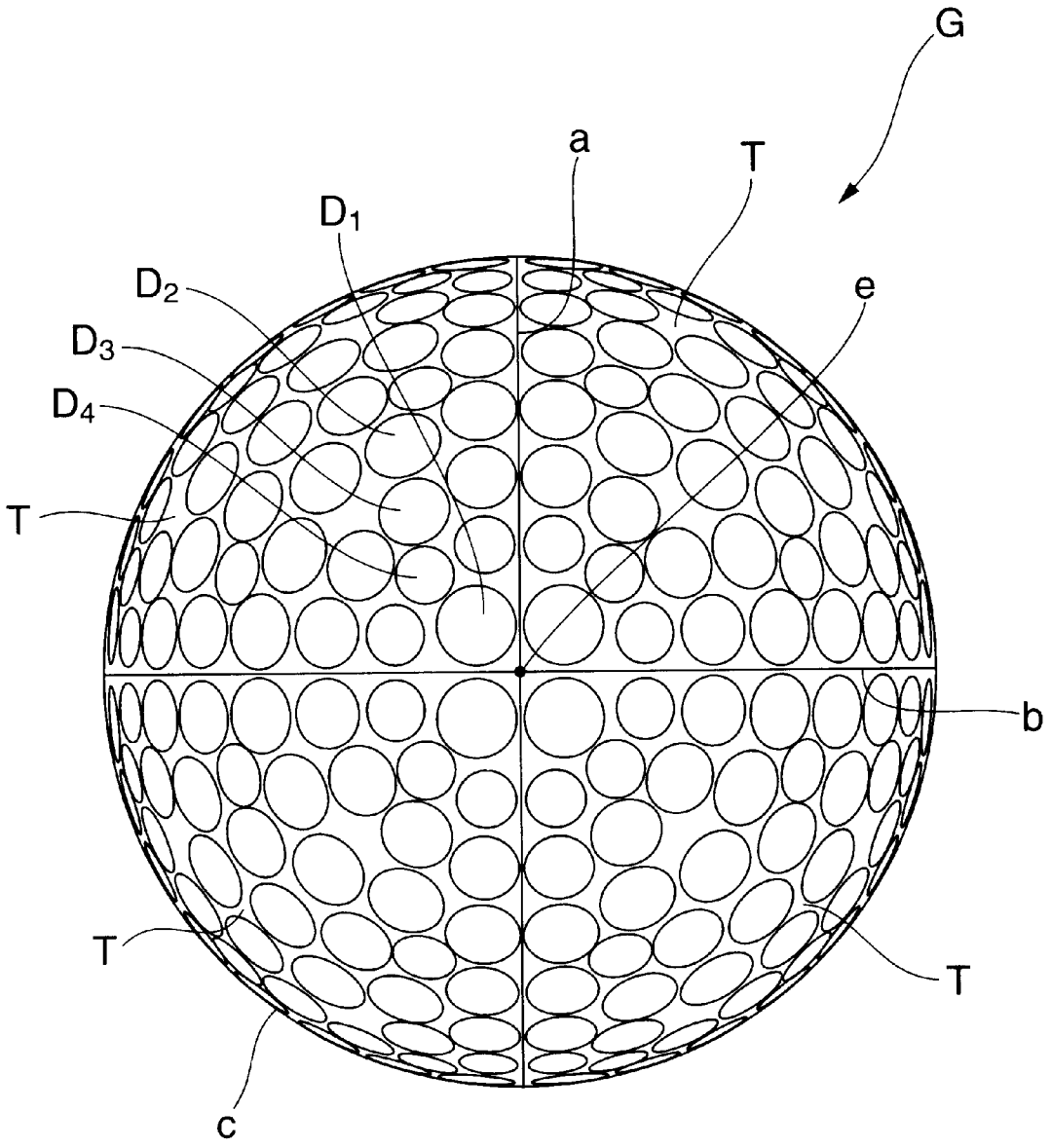
FIG. 13 is a plan view, as seen from the pole direction, showing a golf ball according to a comparative example.

FIG. 13 is a plan view showing a golf ball according to a comparative example, on the surface of which dimples are arranged in accordance with a conventional spherical regular octahedron arrangement method.

According to the comparative example, four types of dimples different in diameter and/or depth, more specifically, large dimples $D_1$ (diameter: 4.2 mm, depth: 0.2 mm), medium dimples $D_2$ (diameter: 4.0 mm, depth: 0.19 mm), small dimples $D_3$ (diameter: 3.8 mm, depth: 0.18 mm), and the minimum dimples $D_4$ (diameter: 3.2 mm, depth: 0.15 mm) are equally arranged on the spherical surface of the golf ball. The total number of the dimples is set to 368. In this comparative example, on the spherical surface of the golf ball, there are three great circles "a", "b" and "c" with which any one of the dimples does not intersect.

Next, there will be described an experiment in which the golf balls having the dimple arrangements in Embodiments 1 to 4 and Comparative Example are produced and then evaluated in terms of the flying performance.

[Experiment]

Two-piece sold golf balls in accordance with Embodiments (Examples) 1 to 4 and Comparative Example were produced as follows:

A rubber material having the following rubber composition was kneaded by a kneading roll and hot-pressed, to prepare a solid core having a diameter of 38.5 mm.

| Rubber Composition | |
|---|---|
| cis-1,4-polybutadiene | 100 parts by weight |
| zinc acrylate | 24 parts by weight |
| zinc oxide | 19 parts by weight |
| anti-aging agent | 1 part by weight |
| dicumyl peroxide | 1 part by weight |

The solid core thus prepared was covered with a cover having a thickness of 2.1 mm by injection-molding a cover material mainly containing an ionomer resin around the solid core, to obtain a golf ball.

On the surface of each of the golf balls thus obtained, dimples whose types are shown in Table 1 are arranged in accordance with each of the dimple arrangements shown in FIGS. 1, 2 and 7 to 13.

The flying performance of each of the golf balls obtained in accordance with Embodiments (Examples) 1 to 4 and Comparative Example was evaluated under the following condition. The results are shown in Table 1.

Condition of Flying Distance Test

Ten balls were hit at a head speed of 45 m/sec by using a hitting robot on which a driver (#W1) was mounted while the hitting point was changed for each hitting, and the maximum, minimum, and average values of the carry and the total distance were measured.

TABLE 1

| | | Example 1 | Example 2 | Example 3 | Example 4 | Comparative Example |
|---|---|---|---|---|---|---|
| | Dimple | | | | | |
| 1 | Diameter (mm) | 4.0 | 4.0 | 3.8 | 3.8 | 4.2 |
| | Depth (mm) | 0.19 | 0.19 | 0.18 | 0.18 | 0.2 |
| | Count | 72 | 48 | 336 | 288 | 56 |
| 2 | Diameter (mm) | 3.8 | 3.8 | 3.2 | 3.2 | 4.0 |
| | Depth (mm) | 0.18 | 0.18 | 0.15 | 0.15 | 0.19 |
| | Count | 200 | 254 | 48 | 78 | 120 |
| 3 | Diameter (mm) | 3.15 | 3.15 | 2.35 | 2.35 | 3.8 |
| | Depth (mm) | 0.16 | 0.16 | 0.13 | 0.13 | 0.18 |
| | Count | 120 | 72 | 24 | 72 | 96 |
| 4 | Diameter (mm) | | 2.35 | | | 3.2 |
| | Depth (mm) | | 0.13 | | | 0.15 |
| | Count | | 24 | | | 96 |
| | Total | 392 | 398 | 408 | 438 | 368 |
| | Dimple Arrangement | FIG. 1 FIG. 2 | FIG. 7 FIG. 8 | FIG. 9 FIG. 10 | FIG. 11 FIG. 12 | FIG. 13 |
| | Number of great circles with which none of dimples intersects | 0 | 0 | 0 | 0 | 3 |
| | Number of dimples intersecting with great circle | 18*1 | 30*1 | 24*1 | 24*1 | 0*2 |
| | Flying Test | | | | | |
| Carry | Maximum (m) | 214 | 214 | 213 | 212 | 206 |
| | Minimum (m) | 218 | 218 | 216 | 216 | 213 |
| | Average (m) | 216 | 215 | 215 | 214 | 210 |
| Total | Maximum (m) | 225 | 226 | 225 | 225 | 215 |
| | Minimum (m) | 231 | 232 | 231 | 230 | 228 |
| | Average (m) | 228 | 229 | 228 | 227 | 223 |

*1Number of dimples partially intersecting with each of great circles passing through mid points of sides of spherical triangles

*2Number of dimples intersecting with each of great circles formed by mutual extensions of three sides of spherical triangles As is apparent from Table 1, in the case of the ball in Comparative Example, in which there are three great circles with which any one of dimples does not intersect and dimples are not uniformly arranged on the surface of the ball, a difference between the maximum value and the minimum value of the flying performance is as large as 7 m, with a result that the ball has not a uniform flying performance.

On the contrary, in the case of the ball in Examples 1 to 4, in which there is no great circle with which any one of dimples does not intersect and dimples are equally arranged on the surface of the ball, a difference between the maximum value and the minimum value of the carry and the total distance in the flying test is as small as 4 m or less, with a result that the ball has a uniform flying performance and exhibits a large flying distance.

The golf ball of the present invention having the above-described configuration is not particularly limited in terms of other constituent elements, and therefore, it is applicable to various kinds of golf balls, for example, a solid golf ball such as a one-piece golf ball, a two-piece golf ball, or a multi-piece golf ball having three or more layers, and a thread wound golf ball. The golf ball of the present invention can be produced from a known material by an ordinary process. It should be noted that the characteristics such as the weight, diameters of a ball can be suitably set under a golf rule.

While the preferred embodiments have been described using the specific terms, such description is for illustrative purposes only, and it is to be understood that changes and variations may be made without departing from the spirit or scope of the following claims.

What is claimed is:

1. A golf ball comprising:

a plurality of dimples arranged overall on the spherical surface of said golf ball by assuming the spherical surface of said golf ball as a spherical octahedron and using, as dimple arrangement units, eight spherical triangles constituting said spherical octahedron, on each of which a specific number of said dimples are arranged;

wherein at least four of said dimples are arranged on each of three sides of said spherical triangle;

there is no great circle with which any one of said dimples does not intersect;

wherein one of four great circles formed by connecting associated ones of mid points of sides of said spherical triangles to each other is an equatorial line which substantially corresponds to a parting plane of a two-half mold for molding said golf ball and a plurality of the dimples are located on each of said four great circles in such a manner as to partially intersect with the great circles;

the total number of said dimples is in a range of 380 to 450.

2. A golf ball according to claim 1, wherein the number of dimples partially intersecting with each of said four great circles is in a range of 6 to 42.

3. A golf ball comprising:

a plurality of dimples arranged overall on the spherical surface of said golf ball by assuming the spherical surface of said golf ball as a spherical octahedron and using, as dimple arrangement units, eight spherical triangles constituting said spherical octahedron, on each of which a specific number of said dimples are arranged;

wherein at least four of said dimples are arranged on each of three sides of said spherical triangle;

there is no great circle with which any one of said dimples does not intersect;

wherein one of four great circles formed by connecting associated ones of mid points of sides of said spherical trangles to each other is an equatorial line which substantially corresponds to a parting plane of a two-half mold for molding said golf ball and said great circle corresponding to the equatorial line has no dimple whose center intersects with said great circle, but has dimples which partially intersect therewith, and a ratio [(E/DM)×100] of an intersection width E between a dimple and each one of said four great circles to a diameter Dm of the dimple is a range of 40% or less;

the total number of said dimples is in a range of 380 to 450.

4. A golf ball according to claim 3, wherein the ratio of the intersection width between the dimple and each one of said four great circles to the diameter Dm of the dimple is in a range of 10 to 30%.

5. A golf ball according to claim 1, wherein said parting plane of a two-half mold for molding the golf ball is formed by a portion extending on the equatorial line in a land forming portion and a portion extending along the edges of projection for forming dimples.

6. A golf ball according to claim 1, wherein said dimples of 6 to 42 intersect with each of said great circles.

7. A golf ball according to claim 6, wherein any one of said dimples is not located at said mid point of each side of said spherical triangle.

* * * * *